US007413101B2

(12) United States Patent
Smalley et al.

(10) Patent No.: US 7,413,101 B2
(45) Date of Patent: Aug. 19, 2008

(54) DISPENSING PACKAGE

(75) Inventors: Brian Leslie Smalley, Bristol (GB); Zoe Wilkins, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/533,492

(22) Filed: Sep. 20, 2006

(65) Prior Publication Data

US 2007/0012756 A1 Jan. 18, 2007

Related U.S. Application Data

(63) Continuation of application No. 10/523,887, filed on Sep. 6, 2005.

(30) Foreign Application Priority Data

Aug. 8, 2002 (GB) ..... 0218392.9
Jul. 31, 2003 (WO) ..... PCT/GB03/03351

(51) Int. Cl.
*G07F 11/16* (2006.01)

(52) U.S. Cl. ..... 221/309; 221/303; 221/305; 221/307; 229/100; 229/120.02; 229/122.1

(58) Field of Classification Search ..... 221/1–312 C; 229/120.02, 120.05, 120.06, 100; 220/532
See application file for complete search history.

(56) References Cited

U.S. PATENT DOCUMENTS 2,928,539 A 3/1960 Chirchlglia
3,300,115 A * 1/1967 Schauer ..... 221/305
3,356,279 A 12/1967 Root
4,170,325 A * 10/1979 Pawlowski et al. ..... 206/526
4,364,509 A * 12/1982 Holley et al. ..... 221/305
4,396,143 A * 8/1983 Killy ..... 221/305
4,958,734 A * 9/1990 Wood et al. ..... 206/435
5,368,194 A * 11/1994 Oliff et al. ..... 221/305
5,516,037 A 5/1996 Okamoto et al.
5,518,111 A * 5/1996 Stout ..... 206/160
5,669,500 A * 9/1997 Sutherland ..... 206/427
6,062,424 A * 5/2000 Simile-Gravina et al. ... 221/305
6,176,419 B1 * 1/2001 Holley, Jr. ..... 229/122.1
6,604,677 B1 * 8/2003 Sutherland et al. ..... 229/242
6,929,172 B2 * 8/2005 Bates et al. ..... 229/244
6,991,107 B2 1/2006 Harrelson
7,000,803 B2 * 2/2006 Miller ..... 221/302

(Continued)

FOREIGN PATENT DOCUMENTS

JP 7-315375 5/1995

(Continued)

*Primary Examiner*—Gene O. Crawford
*Assistant Examiner*—Michael K Collins
(74) *Attorney, Agent, or Firm*—Womble Carlyle Sandridge & Rice, PLLC

(57) ABSTRACT

A paperboard carton for receiving articles in two or more layers separated by a divider pad is provided. The divider pad is secured relative to an end panel arrangement at one end of the carton. The carton has a top panel, a base panel and a pair of opposite sides. One of the side panels has a removable portion adjacent one end, which, when removed, defines a roll out aperture for article removal when the carton is lying on the end panel arrangement.

23 Claims, 6 Drawing Sheets

U.S. PATENT DOCUMENTS

| | | | | |
|---|---|---|---|---|
| 7,073,665 | B2 | 7/2006 | Auclair et al. | |
| 7,175,047 | B2 * | 2/2007 | Spivey | 221/305 |
| 2006/0249529 | A1 * | 11/2006 | Smalley et al. | 221/305 |

FOREIGN PATENT DOCUMENTS

| | | |
|---|---|---|
| JP | 9-502147 | 3/1997 |
| JP | 2004-527010 | 7/2004 |
| WO | WO 95/06425 | 3/1995 |
| WO | WO 02/14166 A1 | 2/2002 |

* cited by examiner

DISPENSING PACKAGE

CROSS-REFERENCE TO RELATED APPLICATION

This application is a continuation of U.S. application Ser. No. 10/523,887, filed Sep. 6, 2005, which application claims priority under 35 U.S.C. §119(b) to British application serial no. 0218392.9, filed on Aug. 8, 2002, and PCT application Ser. No. PCT/GB03/03351, filed on Jul. 31, 2003, under 35 U.S.C. §363, the contents of which are hereby incorporated in their entirety as if repeated herein.

BACKGROUND OF THE INVENTION

The present invention relates to dispensing packages and more particularly, but not exclusively, those for canned products such as food and drink.

SUMMARY OF THE INVENTION

Commonly, canned food/drink products are supplied in a shallow tray made of paperboard or corrugated board, with a shrink wrapping of plastic film. A number of these shrink wrapped trays are often stacked one above the other on a supermarket shelf. The trays are usually stacked on their widest surface which can be considered as lacking space efficiency, particularly if only one tray is on the shelf. Additionally the shrink wrap is not good for assisting in product differentiation.

According to the present invention there is provided a paperboard carton for articles arranged in at least two layers, the carton having a top panel, a base panel, a pair of oppositely disposed side panels and a pair of oppositely disposed end panel arrangements, a divider pad being provided between the adjacent layers of articles and being secured relative to the end panel arrangement at one end, one of the side panels having a removable portion adjacent said one end so as to define a roll-out aperture for article removal when the carton is lying on said one end panel arrangement.

Preferably the divider pad is secured relative to the other end panel arrangement. Conveniently each end panel arrangement comprises a pair of oppositely disposed side end flaps hingedly connected to the side panels and a pair of oppositely disposed main end flaps hingedly connected to the top and base panels respectively.

In preferred embodiments the divider pad has a fold down gluing panel at the or each secured end. With a preferred arrangement the top end flap is folded down last and is adhesively secured to all its associated end flaps of its associated end panel arrangement and to its associated fold down gluing panel.

Ideally a single straight glue line effects said adhesive attachment of the top end flap to the other end flaps and gluing panel. In one such embodiment the base end flap has a central projecting area such that the straight glue line is provided in turn on one of the side end flaps, the gluing panel, the central area of the base end flaps, the gluing panel and the other side end flap.

In further preferred embodiments said removable portion extends into the top and base panels to aid removal of the articles and also said removable portion is defined by perforations or other lines of weakening.

Normally, the top panel, base panel, two side and two end panel arrangement panels are substantially rectangular but other arrangements could be envisaged.

With preferred arrangements one or more cuts extend partway to the adjacent end from the removable portion. Conveniently two of said cuts extend along the folds between said one side panel and the top and base panels respectively and also a transverse cut is provided at the end of the or each cut remote from the removable portion.

BRIEF DESCRIPTION OF THE DRAWINGS

Embodiments of the present invention will now be described in more detail. The description makes reference to the accompanying drawings in which.

DETAILED DESCRIPTION

Figure 1:
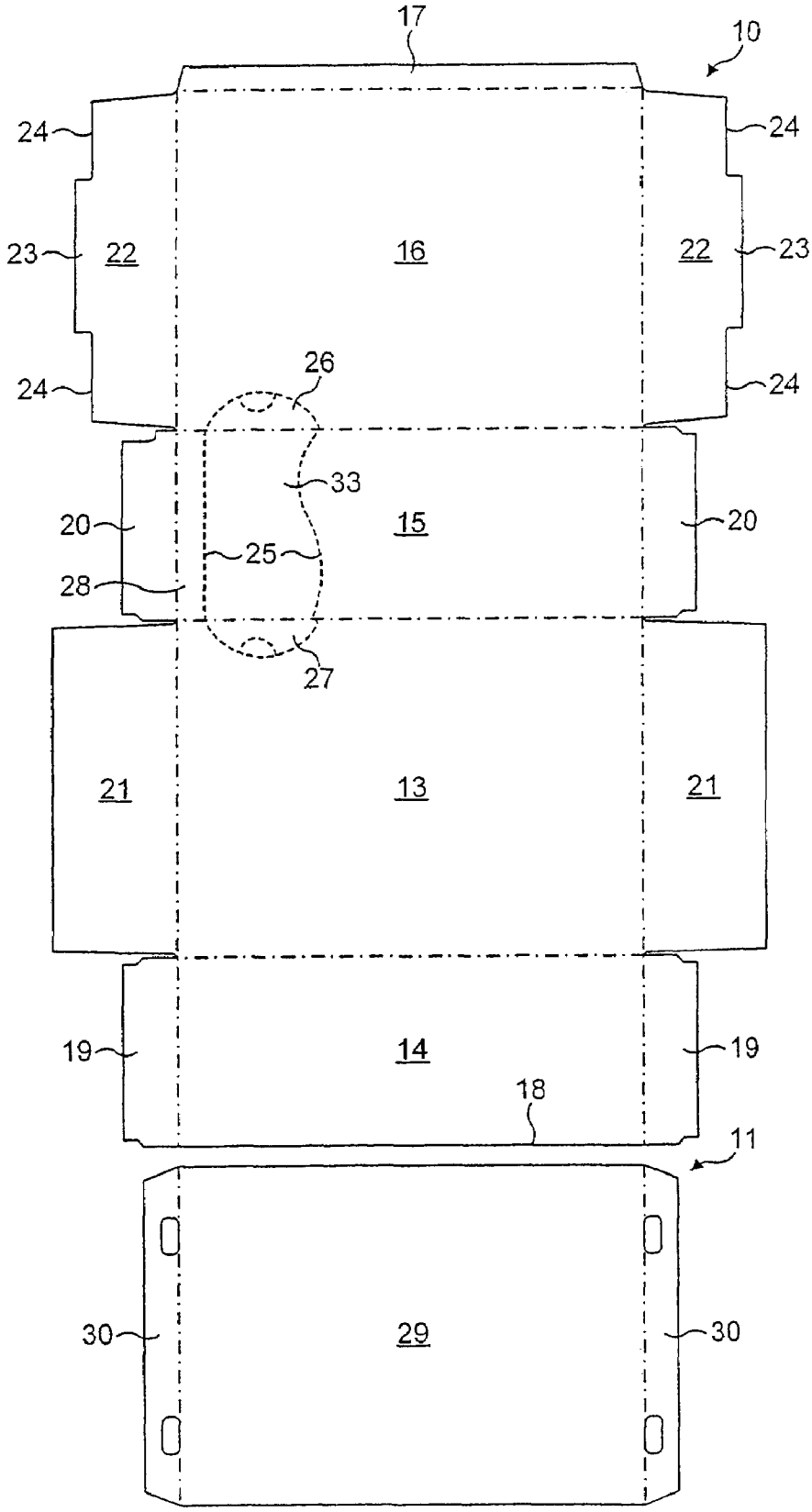
FIG. 1 shows two paperboard blanks for producing a carton according to the present invention.
Figure 6:
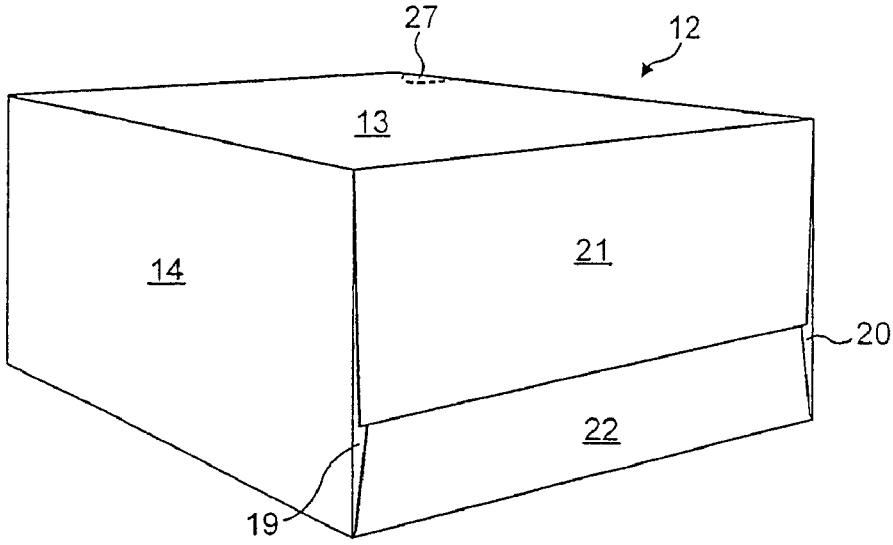
Figure 7:
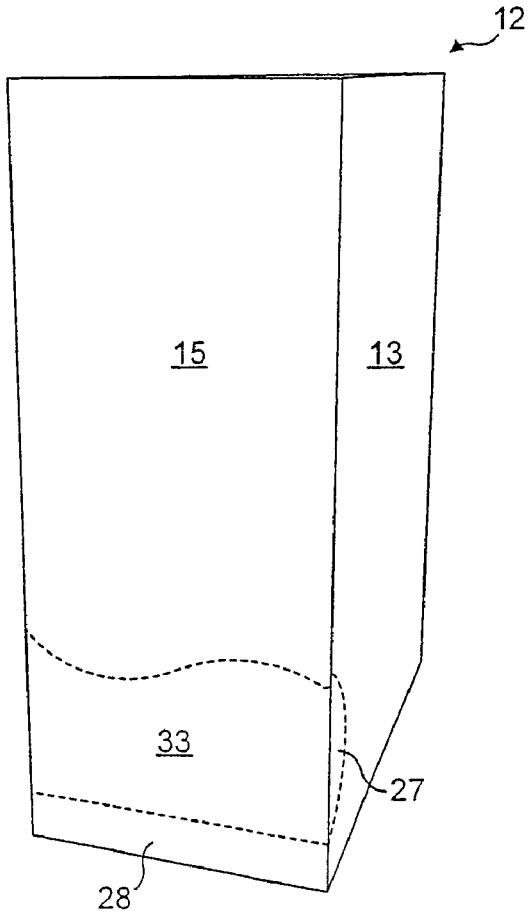
FIG. 7 is a side perspective view of the assembled carton standing on one end.

In FIG. 1 there is shown a pair of paperboard blanks 10, 11 for producing a carton 12 which is shown in FIG. 7 in an assembled condition standing on one end. The various stages of assembly are illustrated in perspective in FIGS. 2 to 6.

The main blank 10 is used to form the basic carton shape and provides a top panel 13 hingedly connected to oppositely disposed side panels 14, 15. Side panel 15 is in turn hingedly connected to a base panel 16 which is hingedly connected to an adhesive flap 17. The main blank 10 is formed into a general sleeve shape by adhering the adhesive flap 17 to the area adjacent the free edge 18 of the side panel 14.

Side end flaps 19, 20 are hingedly connected to side panels 14, 15 respectively at each end of the blank 10. A top end flap 21 is hingedly connected to the top panel 13 at each end and similarly a base end flap 22 is hingedly connected to the base panel 16 at each end of the blank 10. Each base end flap 22 has a central area 23 which projects beyond the adjacent free edges 24 of the base end flap 22 and the reason for this will be clarified later.

Side panel 15 also incorporates a removable portion 33 defined by lines of weakening 25 such as perforations. The removable portion 33 extends partially at 26 into the base panel 16 and at 27 into the top panel 13. A small portion 28 of the side panel 15 is intended to remain after the removable portion 33 has been removed thereby to act as a stop wall. Other forms and shapes of roll-out feature could also be substituted for the illustrated one.

The second blank 11, a divider pad, comprises a rectangular main panel 29 which corresponds in size and shape to the top and base panels 13, 16 of the main blank 10. At each end of the main panel 29 a fold-down glue panel 30 is hingedly connected.

Figure 2:
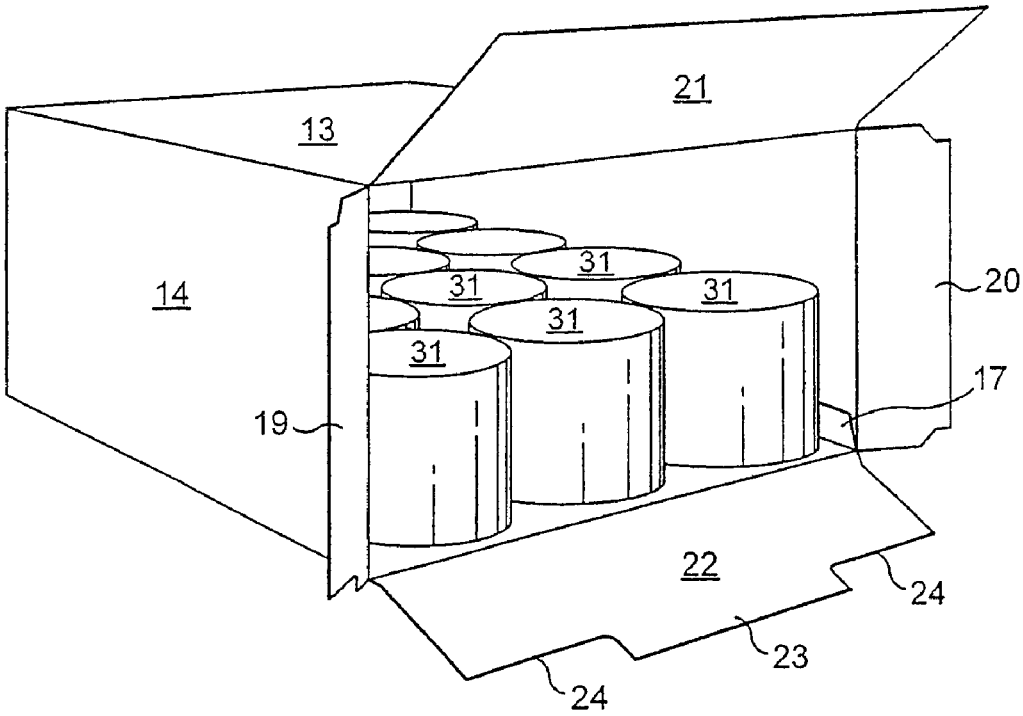
FIGS. 2 to 6 are end perspective views showing the stages of assembly of the blanks of FIG. 1 to form the carton according to the present invention.
Figure 3:
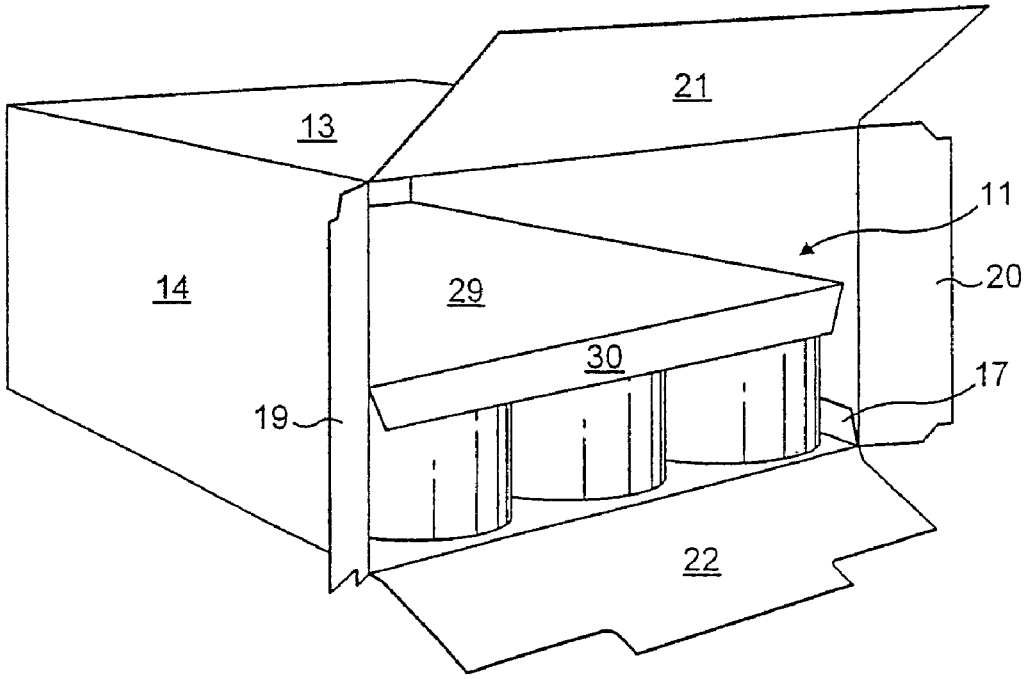
Figure 4:
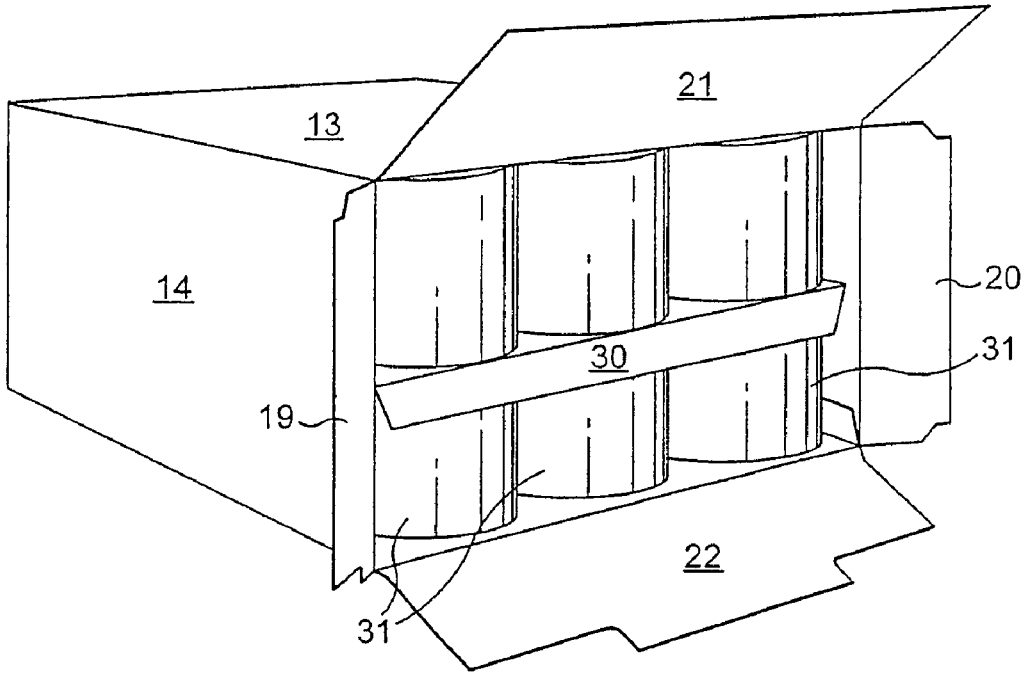
Figure 5:
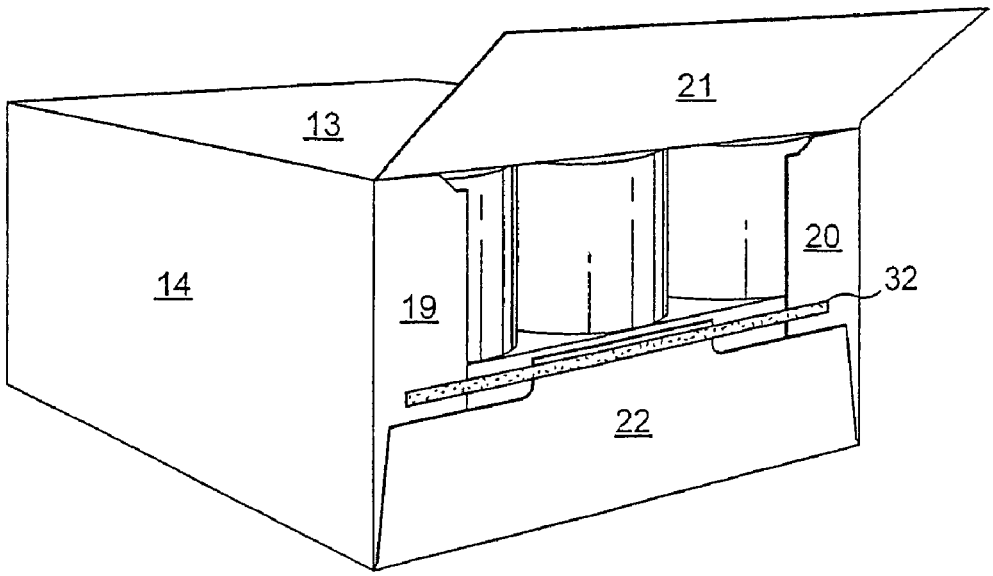

To assemble the carton 12 the adhesive flap 17 of the main blank 10 is secured to the side panel 14 and the main blank 10 is opened up to form an open-ended sleeve. A layer of cans 31 are then inserted into the sleeve so as to have their ends lying on the base panel 16 as shown in FIG. 2. The second blank 11 is then inserted as shown in FIG. 3 so as to lie on top of the layer of cans 31. A second layer of cans 31 is then inserted into the sleeve so as to lie on top of the main panel 29 of the divider pad 11 with the glue panels 30 folded down at both ends of the sleeve so as to lie against the lower layer of cans 31, as shown in FIG. 4. The side end flaps 19, 20 at each end are then folded in and the base end flaps 22 are folded up and at each end a single straight glue line 32 is applied to the side end flaps 19, 20, the glue panel 30 and to the central area 23 of the base end flap 22 as shown in FIG. 5. The top end flap 21 at each end is then folded down into contact with the glue line 32 so as to be adhesively secured to the glue panel 30, the base end flap 22 and the side end flaps 19, 20.

Figure 8:
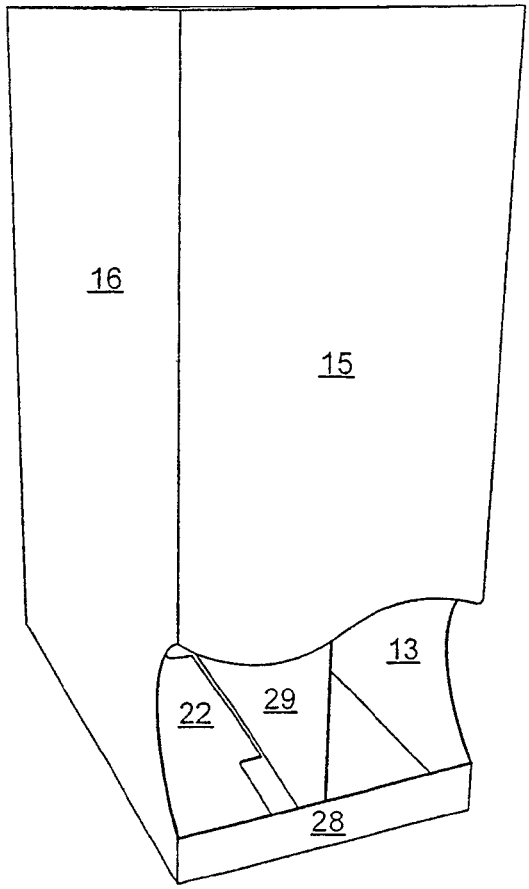
FIG. 8 is another side perspective view of the assembled carton standing on one side with a removable portion removed to define a roll-out aperture.

The carton 12 is thus fully assembled as shown in FIG. 6 and all panels can display product and promotion information, advertising, logos, competition details etc. In store, the carton 12 can be placed on a shelf on its end adjacent the removable portion 33 which faces toward the consumer. This is shown in FIG. 7. Side panel 15 is, therefore, particularly suited to displaying advertising logos and other information. The removable portion 33 is then removed so as to enable consumers to remove the cans 31 through the resulting roll-out dispensing aperture as shown in FIG. 8. The stop wall 28 prevents the cans 31 from rolling out of the carton 12.

The carton 12 can occupy a relatively small horizontal space on the shelf compared to conventional shrink-wrapped trays for cans and can provide significant advertising/information areas, for example on the side panel 15.

Figure 9:
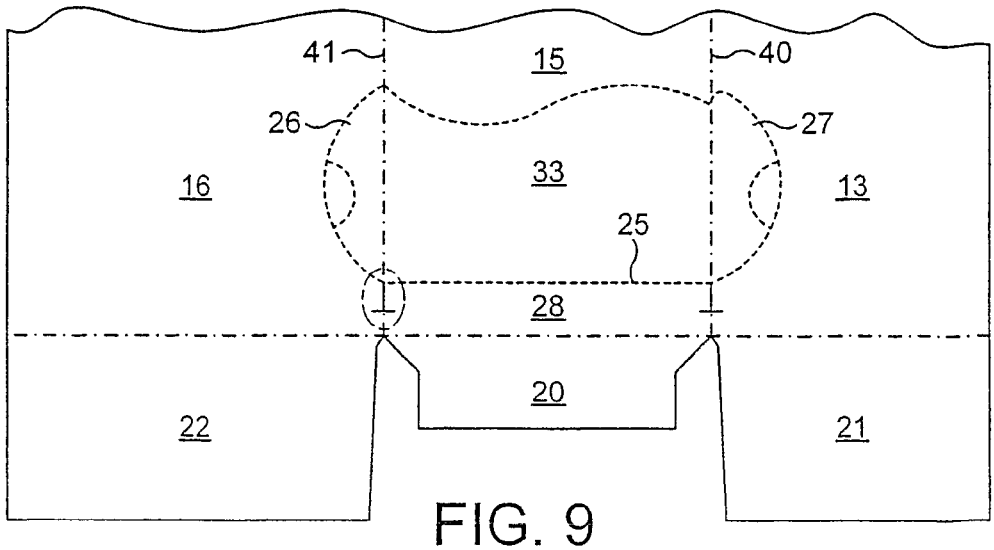
FIG. 9 is an enlarged view of part of a preferred blank for producing a carton according to the present invention.
Figure 10:
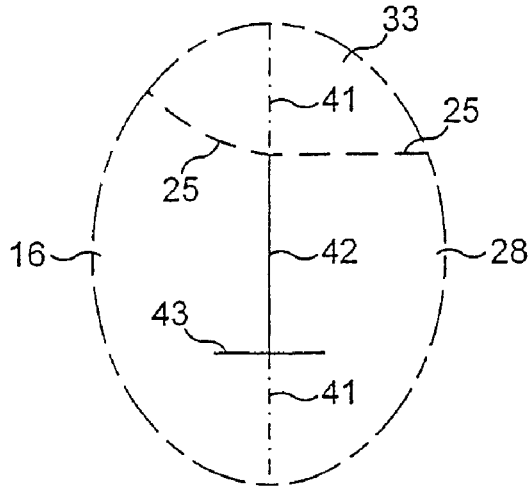
FIG. 10 is a further enlarged view of a detail of FIG. 9.
Figure 11:
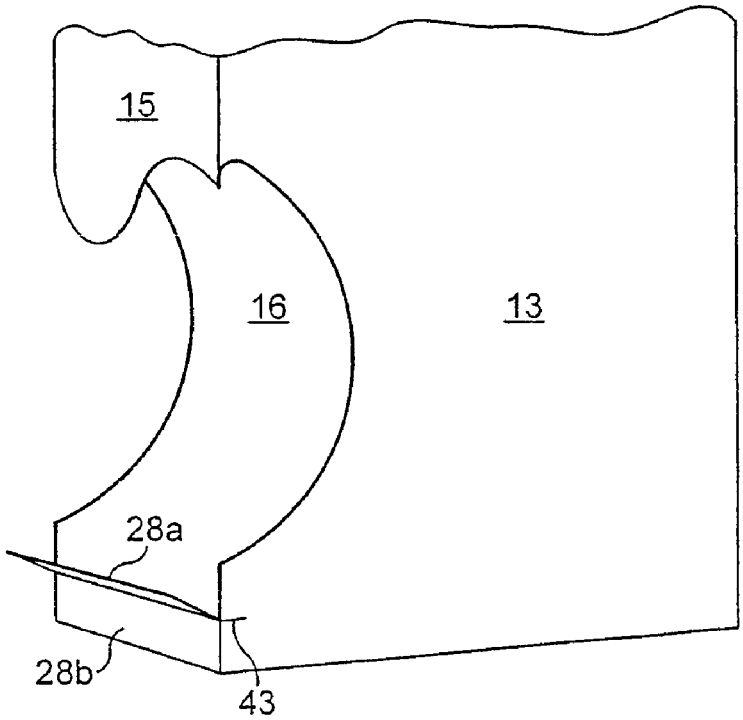
FIG. 11 shows a perspective view during use of the lower part only of a carton assembled using a blank incorporating the FIG. 10 detail.

In FIGS. 9 to 11 there is shown a modification to the above-mentioned arrangement. Like parts, however, have been given like reference numerals. Looking at the blank detail in FIGS. 9 and 10, the folds between the side panel 15 and the top panel 13 and the base panel 16 are indicated by numerals 40 and 41 respectively. The line of weakening 25 adjacent the stop wall 28 crosses the folds 40 and 41. The modification is to provide a cut 42 in each fold 40, 41, which cut 42 extends from the line of weakening 25 towards but short of the side end flap 20. A short transverse cut 43 is provided at the end of each cut 42 and the transverse cuts 43 extend a short distance into the stop wall 28 and the base panel 16 or top panel 13 respectively. Between the transverse cuts 43 and the side end flap 20 the folds 40, 41 remain uncut.

The modified blank is assembled in the same way as blank 10 of FIG. 1 and is secured with respect to blank 11 in the same way. Once the pack is opened, however, there is a small difference in operation after the removable portion 33 has been removed. Instead of the entire stop wall 28 being fixed relative to the now upright base and top panels 16, 13, the now upper part 28*a* of the stop wall 28 is able to flex outwardly as illustrated in FIG. 11. The lower part 28*b* of the stop wall 28 remains fixed relative to the base and top panels 16, 13. This outward flexing of the upper part 28*a* is made possible by the provision of the cuts 42 in the folds 40, 41 and makes it easier to remove the cans from the carton. The transverse cuts 43, which are optional, tend to prevent the cuts 42 from extending beyond their intended length towards the side end flap 20.

In this particular embodiment the cuts 42 extend about halfway towards the side end flap 20, but the dimensions are a matter of design choice dependent on the can and other carton dimensions. In addition, although the cuts 42 are shown as extending along the folds 40, 41, alternative cuts could be provided in other locations to facilitate removal of the cans.

It will be appreciated that other products could be packaged in this way, not just cylindrical cans, although cylindrical articles are particularly well suited to the carton. In addition the carton could be modified to accommodate more than two layers of cans, each layer separated by a divider pad which is secured at least to the end panel arrangement adjacent the roll-out aperture and preferably to both end panel arrangements. Other methods of assembly of the finished carton could also be readily envisaged.

While the invention has been disclosed in its preferred forms, it will be apparent to those skilled in the art that many modifications, additions, and deletions can be made herein without departing from the spirit and scope of the invention and its equivalents as set forth in the following claims.

We claim:

1. An enclosed carton for a plurality of containers disposed in a plurality of rows, including a first row disposed above a second row, the carton comprising:

six sides, the six sides including a first side disposed between a second side and a third side, a fourth side being perpendicular the first side, the first side being perpendicular to the second side and the third side, the second side and the third side being parallel;

top and bottom tear lines that extend across the first side and into at least the second side or the third side; the bottom tear line being spaced above the fourth side; the top and bottom tear lines at least partially defining an opening flap that is detachable along the tear lines to create an opening therebetween; and at least one flexible portion being disposed adjacent the opening flap; the at least one flexible portion, when engaged, enlarges the opening to create an enlarged opening; the enlarged opening enabling easier container removal from the carton than the opening alone;

wherein the flexible portion is defined by at least one separation line and a transverse cut is provided at a terminus of the at least one separation line.

2. The carton of claim 1, wherein the at least one separation line is a cut.

3. The carton of claim 1, wherein the top and bottom tear lines extend into both the second and the third sides.

4. The carton of claim 1, wherein when the opening is created, all of the containers in the carton are prevented from rolling out.

5. The carton of claim 1, wherein the at least one flexible portion includes two aligned cuts, and the at least one flexible portion is pivoted between the two cuts.

6. The carton of claim 1, wherein the at least one flexible portion extends across the first side from the second side to the third side.

7. The carton of claim 1, wherein the at least one flexible portion is adjacent the bottom tear line.

8. The carton of claim 1, wherein a stop wall is formed in the first side between the bottom tear line and the bottom panel to prevent containers from rolling out of the carton.

9. The carton of claim 8, wherein the at least one flexible portion is adjacent the stop wall.

10. The carton of claim 1, wherein the width of the at least one flexible portion is coextensive with the width of the first side.

11. A method for dispensing a cylindrical container from an opening in an enclosed carton containing a plurality of containers disposed in a plurality of rows, including a first row disposed above a second row, the carton having six sides, the six sides including a first side disposed between a second side and a third side, a fourth side being perpendicular the first side, the first side being perpendicular to the second side and the third side, the second side and the third side being parallel, top and bottom tear lines that extend across the first side and into at least the second side or the third side, the top and bottom tear lines at least partially defining an opening flap that is detachable along the tear lines to create an opening therebetween, the bottom tear line being spaced above the fourth side; at least one flexible portion being disposed adjacent the opening flap, the at least one flexible portion, when engaged, enlarges the opening to create an enlarged opening, wherein the flexible portion is defined by at least one separation line and a transverse cut is provided at a terminus of the at least one separation line, said method comprising:

placing the carton so that the fourth side is on an approximately horizontal plane;

separating said top and bottom tear lines to create the opening;

engaging the at least one flexible portion to create the enlarged opening;

grasping a container; and removing the container from the carton;

whereby the enlarged opening enables easier container removal from the carton than the opening alone.

12. The method of claim 11, wherein the at least one separation line is a cut.

13. The method of claim 11, wherein the top and bottom tear lines extend into both the second and third sides.

14. The method of claim 11, wherein when the opening is created, all of the containers in the carton are prevented from rolling out.

15. The method of claim 11, wherein the at least one flexible portion extends across the first side from the second side to the third side.

16. The method of claim 11, wherein the at least one flexible portion is adjacent the bottom tear line.

17. The method of claim 11, wherein a stop wall is formed in the first side to prevent containers from rolling out of the carton.

18. The method of claim 11, wherein the width of the at least one flexible portion is coextensive with the width of the first side.

19. The method of claim 11, wherein the at least one flexible portion is adjacent the stop wall.

20. The method of claim 11, wherein the at least one flexible portion includes at least one separation line and a transverse cut is provided at a terminus of the at least one separation line, the step of engaging the at least one flexible portion comprising:

hinging the at least one flexible portion about the at least one separation line.

21. The method of claim 20, wherein a transverse cut is provided at a terminus of the at least one separation line.

22. The method of claim 20, wherein hinging the at least one flexible portion includes outwardly hinging about the at least one separation line.

23. The method of claim 11, wherein the at least one flexible portion includes two aligned cuts, and the at least one flexible portion is pivoted outwardly about the two cuts.

* * * * *